United States Patent [19]

Beller et al.

[11] Patent Number: 5,032,977

[45] Date of Patent: Jul. 16, 1991

[54] SYSTEM FOR MODELING AND CONTROL FOR DELIGNIFICATION OF PULPING

[75] Inventors: Jeffrey A. Beller, Willoughby; Ralph K. Johnson, Highland Heights, both of Ohio; Roger Kammerer, Mercer Island, Wash.; Azmi Kaya, Akron; Marion A. Keyes, IV, Chagrin Fall, both of Ohio

[73] Assignee: Elsag International B.V., Amsterdam, Netherlands

[21] Appl. No.: 430,855

[22] Filed: Dec. 7, 1989

Related U.S. Application Data

[62] Division of Ser. No. 365,350, Jun. 13, 1989, Pat. No. 4,978,425.

[51] Int. Cl.[5] ..... G06F 15/46; D21C 7/12

[52] U.S. Cl. ..... 364/165; 162/238; 162/DIG. 10; 364/151; 364/471

[58] Field of Search ..... 364/149-151, 364/471, 497-500, 164, 165, 194; 162/49, 50, 62, 238, 252, 263, DIG. 10, 258

[56] References Cited

U.S. PATENT DOCUMENTS 3,941,649 3/1976 Wallin ..... 162/238 X
4,295,929 10/1981 Leithem ..... 162/84 X
4,348,256 9/1982 Bergstrom et al. .... 162/DIG. 10 X
4,540,468 9/1985 Genco et al. ..... 162/61 X
4,746,405 5/1988 Lisnyansky et al. ..... 162/253 X
4,780,182 10/1988 Baker ..... 162/263 X

*Primary Examiner*—Joseph Ruggiero
*Attorney, Agent, or Firm*—Vytas R. Matas; Robert J. Edwards; Daniel S. Kalka

[57] ABSTRACT

A method and apparatus for controlling the delignification process by monitoring and minimizing variations in the Kappa Number and the digester residual chemical concentration. A parameter representative of the H factor for the delignification process and a measurement of the initial chemical concentration are utilized ot produce signals representative of the actual Kappa Number and the residual acid concentration in the digerter. The expected perturbations in Kappa Number and the residual chemical concentration are compared with target values for same to produce estimated errors due to mismatch which are compared with actual measured errors for these parameters to produce compensated control errors for same. The compensated control errors are utilized to modify the target values for the H factor and the initial chemical concentation by modifiying the chemical charge and the time versus temperature operating parameters of the digestings to regulate pulp Kappa number and spent cooking liquor residual chemical concentrations of the process.

2 Claims, 9 Drawing Sheets

SYSTEM FOR MODELING AND CONTROL FOR DELIGNIFICATION OF PULPING

This is a division of application Ser. No. 07/365,350 filed June 13, 1989 now U.S. Pat. No. 4,978,425.

TECHNICAL FIELD

The present invention relates, in general, to the pulping industry and, more particularly, to a new and useful method and apparatus for controlling the degree of cooking in the pulping delignification process.

BACKGROUND ART

Lignin is the major noncarbohydrate constituent of wood and functions as a natural plastic binder for the cellulose fibers. Lignin can be removed from wood by either the sulfite cooking process or the alkaline cooking process.

It is known that the rate of delignification is proportional to the amount of lignin present in the wood, the chemical pulping reagent concentration present in the wood during the delignification process, and the temperature dependent reaction rate, k. It is further known that the rate of delignification for pulping varies with the temperature in accordance with the Arrhenius equation. From this equation, the temperature dependent reaction rate, k, can be determined and subsequently utilized to determine the "H factor" and the Kappa Number for the delignification process being utilized.

The prior art is primarily concerned with processes associated with wood pulping delignification. For example, U.S. Pat. No. 3,523,060 (Herdel, et al) discloses a modification of the sulfite pulping process wherein a very large quantity of sulfur dioxide is utilized and the delignification process is forced by using a very high temperature.

The Leithem patent (U.S. Pat. No. 4,295,929) is directed to the same sulfite delignification process, however, in this reference the proportion of combined sulfur dioxide used in the digestion process is varied as a function of the rate of heating. In essence, this reference teaches that an increase in the proportion of sulfur dioxide used in the digestion process combined with an increase in the heating rate permits a shortening of the total digestion time. Thus, the Herdel, et al and the Leithem references are directed to variations of the sulfite digestion process in order to shorten the total digestion time.

The Somer, et al patent (U.S. Pat. No. 2,545,389) discloses apparatus for increasing the sulfur dioxide content of the cooking acid used in the process. There is an inverse relationship between sulfur dioxide content and total digestion time, and thus, this reference is directed to the apparatus for increasing the sulfur dioxide content of the cooking acid rather than to the process itself.

It is known that the foregoing principles of sulfite cooking also apply to alkaline cooking. Regardless of the type of cooking utilized, the rate of delignification can be determined and the temperature dependent reaction rate, k, can be integrated over time to produce a single parameter, the H factor, to describe the combination of cooking times and temperatures in conjunction with the kinetic principles of pulping. The H factor is related to the Kappa Number, K, which is a measurement of the degree of cooking.

The implementation of the known background art is done as follows. Typically, pulp is manually sampled from the process periodically and analyzed for the degree of delignification per a standardized lab test procedure. The test result index, pulp Kappa Number, is reported to operations as a guide for manual adjustment of active chemical addition or the time/temperature profile.

Also important is the residual chemical concentration of the spent liquor from the cooking process. This residual chemical has significant impact on total mill operation and economics. Although this process variable may be measured via a conductivity sensing device or sampled from the process for lab analysis, it is normally not included in the manual feedback mechanism. Further, it is difficult for operations, given the large array of variables, to assess the quality parameters for an appropriate adjustment and solve the process interactions manually. Prior art does not incorporate residual chemical as a controlled variable into a control policy for the delignification process.

In view of the foregoing, it has become desirable to develop a method of modeling for controlling the delignification process utilizing the foregoing parameters.

SUMMARY OF THE INVENTION

The present invention solves the product quality problems of delignification associated with the prior art and other problems by providing a method and system for controlling the delignification process by monitoring and minimizing variations in the pulp Kappa Number and the digester residual chemical concentration. The foregoing is accomplished by the simultaneous prediction of two process variable perturbations in, namely, the degree of cooking (Kappa Number) and the residual chemical concentration of the free liquor at discharge of the digester. Furthermore, these two process variables are controlled simultaneously by the multivariable supervisory control techniques to provide both a Kappa Number of product and a residual chemical concentration of spent liquor with a minimum deviation from their respective desired values. The input (manipulated) variables of such cooking process are the pulping chemical reagent concentration at charge and temperature vs. time profile of the digester. The calculations are performed in real-time to continuously update the values of the model parameters and to predict the process variables for a consistent and quality product, under the varying operation conditions. Based on predicted and measured deviations in the process output variables, the input variables are continuously manipulated by using a unique supervisory control structure. The new method and apparatus provides:

1. A semitheoretical kinetic model for the chemical pulp cooking process describing the relationships between the primary input/output states, namely, as inputs, active chemical application and reaction time and temperature, and as outputs, pulp yield (K/Kappa number) and free cooking liquor residual chemical concentration. The same model with inherent features makes it highly applicable to endpoint prediction and control of the pulping process.
2. Simultaneous and predictive control of pulp K/Kappa number and residual chemical concentration by automatic adjustment of process inputs through a multivariable control method incorporating the aforementioned model, as opposed to manual adjustment of each variable separately. The preferential inclusion of residual chemical control differentiates the new method from prior art which concerns itself only with the singular problem of pulp yield (K/Kappa number) control and thus neglects the economic impact of deviations in residual chemical concentration.

3. A model predictive control formulation that is linearized in deviation variables and designed for good performance over the desired operating range making it highly manageable and robust despite modelling errors, as opposed to controller calculations driven by the total values of inferential model estimations which render them sensitive to and dependent on model accuracy.
4. A model predictive control formulation that is simple in design, yet theoretically based, comprising of only fundamental cooking variables and two model parameters, both of which have physical meaning and do not require statistical estimation. A design with minimal potential for error describing the process completely enough for endpoint prediction and control without additional intermediate variables derived from measured states or model parameters exceeding in number these same states, each with error margins whose effects are additive; as opposed to complex models comprising of multiple empirical parameters, often exceeding in number the measured input states and requiring extensive numerical analysis for estimation. These same models are often derived by empirical statistical analysis whose conformity are merely evidenced by fitting to a particular set of observations from a given operation and are not generally transferable or flexible.
5. A means of tracking time varying characteristics of the process from digesting to digesting by updating the model parameters on-line through direct observation, permitted by their physical realization, rather than by complicated statistical parameter estimation methods, e.g., recursive algorithms, maximum likelihood, steepest descent, etc., further, these techniques are often limited to linear models.
6. A uniform method for the regulation of the pulping process for various operating conditions and different mills as the model is general with regards to first principles and whose parameters may be directly observed and updated from measured states. That is, one model for all cooking, as opposed to manual intervention as the conditions vary.
7. Calculations largely by simple function blocks arranged in an innovative way to replace high level computer programming rendering a system with a higher utilization factor.

As a result, the following distinct and significant economic advantages are provided by this invention which were nonexistent in the background art:

a) Assures adequate delignification reaction plus the proper endpoint environment, preventing lignin condensation and loss of yield.
b) Minimizes cellulose degradation and resulting decrease in pulp yield and strength properties.
c) Maintains inorganic loading on chemical recovery operations to a level such as to remove downstream mill production bottlenecks.
d) Enhances washability of the pulp produced.
e) Prevents excessive chemical scaling of black (spent) liquor evaporator tubed.

The model predictive supervisory control produces target values for the two input states of the delignification process, namely, the H factor, $H_t$, describing the time/temperature behavior and the initial chemical concentration, $C_{ot}$, of the liquor within the digester. By using measured and/or assumed values of wood weight and moisture, measured liquor flow and concentration, and measured digester content temperature, the controller internally produces signals of the expected perturbations in the actual process output states, Kappa number, $K_a$, and the residual chemical concentration, $R_a$. These estimates are respectively compared to targeted perturbations of the same, $K_t$ and $R_t$, derived from the target H factor, $H_t$, and chemical concentration, $C_{ot}$. The foregoing comparison produces model mismatch estimated errors as a means of compensating for open loop operation, i.e., actual and target values for H factor and chemical concentration not equal. These estimated errors are subsequently compared with the respective actual measured errors to produce compensated errors. The values of the compensated errors are utilized to modify the target values of the H factor, $H_t$, and the initial chemical concentration, $C_{ot}$, through the model predictive supervisory control. The target H factor, $H_t$, and initial chemical concentration, $C_{ot}$, are then passed to their respective controllers as part of the underlying process.

Such foregoing compensation operates discretely through a desired feedback trajectory as measurements of Kappa number, $K_m$, and residual chemical concentration, $R_m$, become available to remove the effect statistically significant nonstationary disturbances on each of the same and regulate each about their respective target values.

Further, the invention solves both the feedback regulator and step servo problems for each of the controlled variables.

Finally, not limited to the aforementioned, the invention allows for inclusion of feedforward control given a sampled reading of cooking liquor chemical concentration from an in situ measurement during the course of individual digestings. Utilizing the model equations developed herein, an offset in the measured cooking liquor concentrations from an expected value at a sampling moment during the evolution of a digesting may be used to produce a feedforward adjustment of H factor, $H_t$, for the current digesting and/or a feedforward adjustment of initial chemical charge, $C_{ot}$, for following digestings. The design of these adjustments is to remove stationary disturbances of higher frequencies exceeding the bandwidth of the closed-loop system and remove nonstationary disturbances before being realized in the process outputs, Kappa number, Km, and residual chemical concentration of the spent liquor, Rm.

DESCRIPTION OF THE PREFERRED EMBODIMENT

The rate of delignification is primarily a function of the cooking liquor composition and cooking temperature. Since there are established mathematical expressions for the rate of delignification, it is possible to determine how much cooking time is required based upon the cooking temperature for a particular pulp quality. (See Pulp and Paper Manufacture, 2nd Edition, Volume I, *The Pulping of Wood*, pp. 282 to 285.).

The rate of delignification increases rapidly with increasing temperature, but the effect is altered by the active chemical concentration. The delignification reaction rate varies with temperature in accordance with the Arrhenius equation:

$$k=k_o e^{(F-E/RT)}$$

Where:

k=Delignification reaction rate
E=Activation energy
R=Universal gas constant
T=Absolute temperature
$k_o$, F=Constants It has been found that the delignification reaction rate slightly more than doubles with an increase of 10° C. in temperature. It has been further found that cooking is extremely slow for temperatures below 100° C.

If the delignification reaction rate, k, is integrated over time, the H factor results in accordance with the following equation:

$$H=\int k\,dt$$

It has been further found that the H factor is related to the Kappa Number which provides the degree of cooking for the particular delignification process being utilized. The present invention provides a system for multi-variable control of the Kappa Number and the residual chemical concentration in the digester to minimize variations in the Kappa Number and to maintain a uniform residual chemical concentration.

Figure 1:
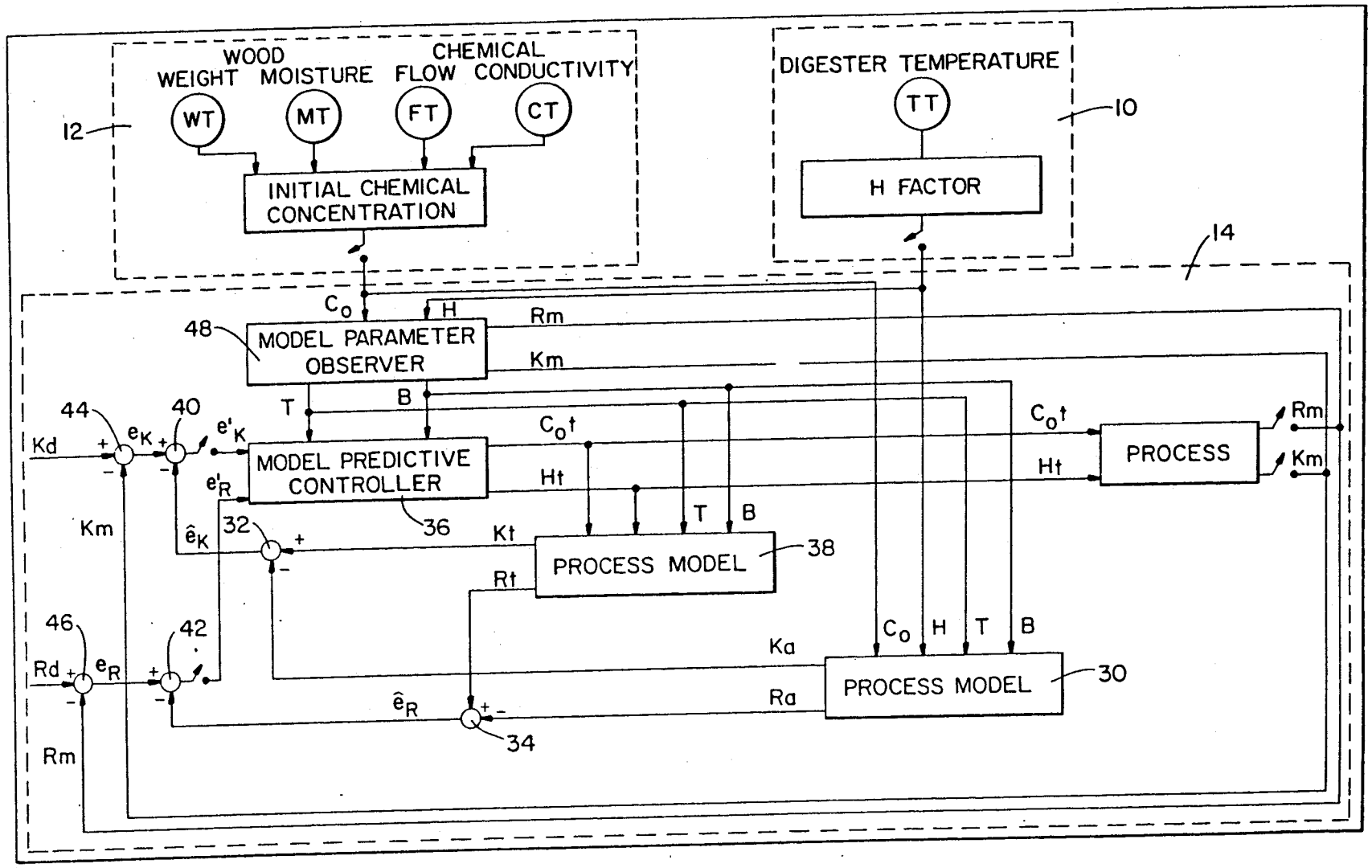
FIG. 1 is a schematic diagram of the control system of the present invention.

Referring now to the drawings where the illustrations are for the purpose of describing the preferred embodiment of the present invention and are not intended to limit the invention thereto, FIG. 1 is a schematic diagram of the control system of the present invention. For each digesting, a subsystem 10 produces the H factor, H, and a subsystem 12 produces a factor representative of the initial chemical concentration, $C_o$, within the digester. A subsystem 14 then provides the means for processing the H factor and the initial chemical concentration, $C_o$, to control the Kappa Number, K, and the residual chemical concentration, R, of the process. It should be noted that the foregoing control system can be implemented in a Bailey Network 90® System. Information concerning the Network 90 System can be found in Bailey Controls Company Application Guide 260-2.

Figure 2:
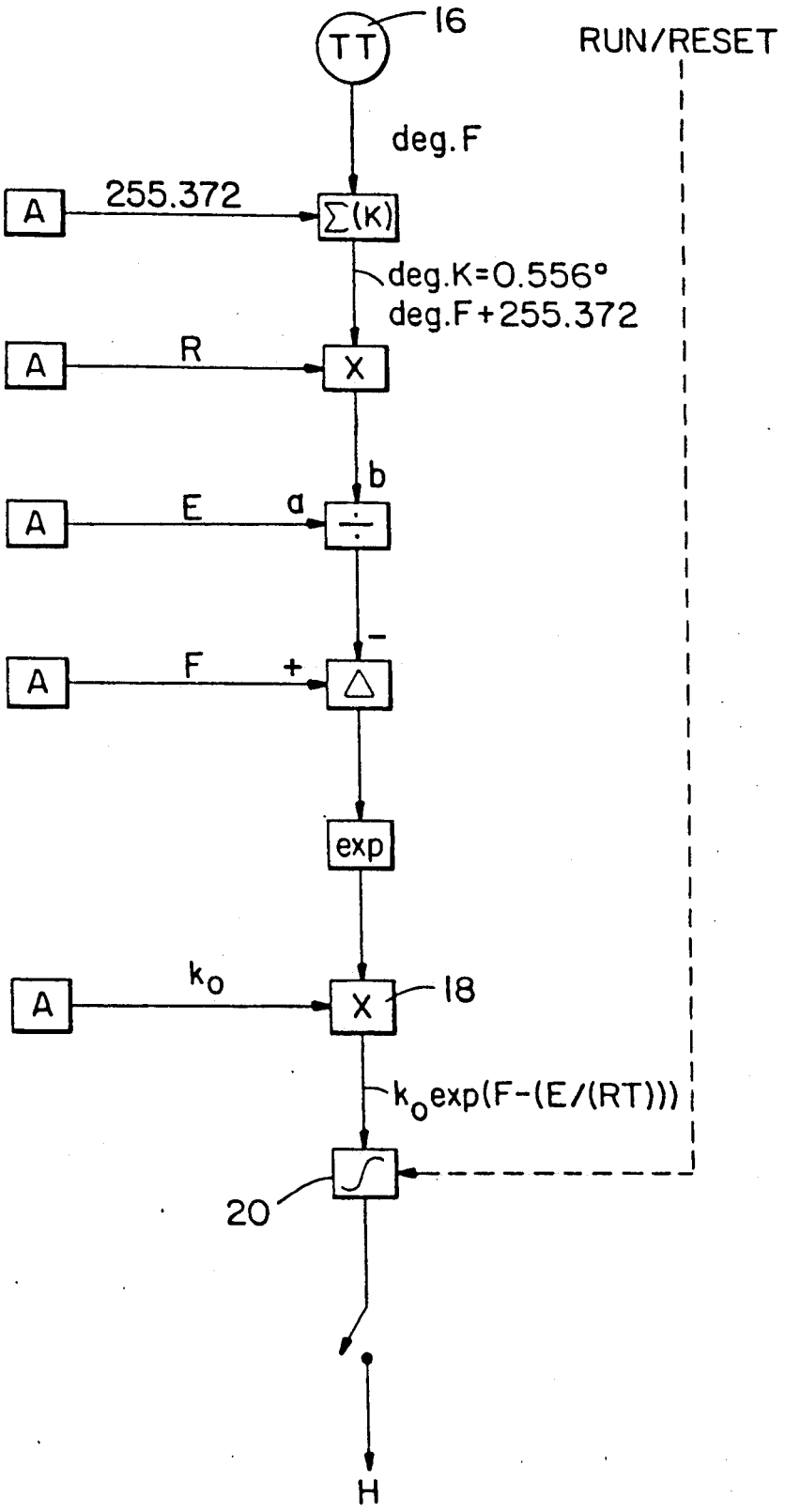
FIG. 2 is a schematic diagram of the logic required to produce a signal representative of the H factor which is utilized in the control system of the present invention.

The subsystem 10 produces the H factor which is related to the Kappa Number, K, for the process. The logic utilized to produce the H factor is shown in FIG. 2. As illustrated, this logic requires a temperature transmitter(s) 16 and various function blocks, first, to convert to absolute temperature (° K.), then to receive and process the universal gas constant (R), the activation energy (E), and constants ($k_o$,F) in order to produce an output from function block 18 representative of the delignification temperature dependent reaction rate, k. The output of function block 18 is connected to an input to integrator function block 20 to produce an output representative of the H factor.

Figure 3:
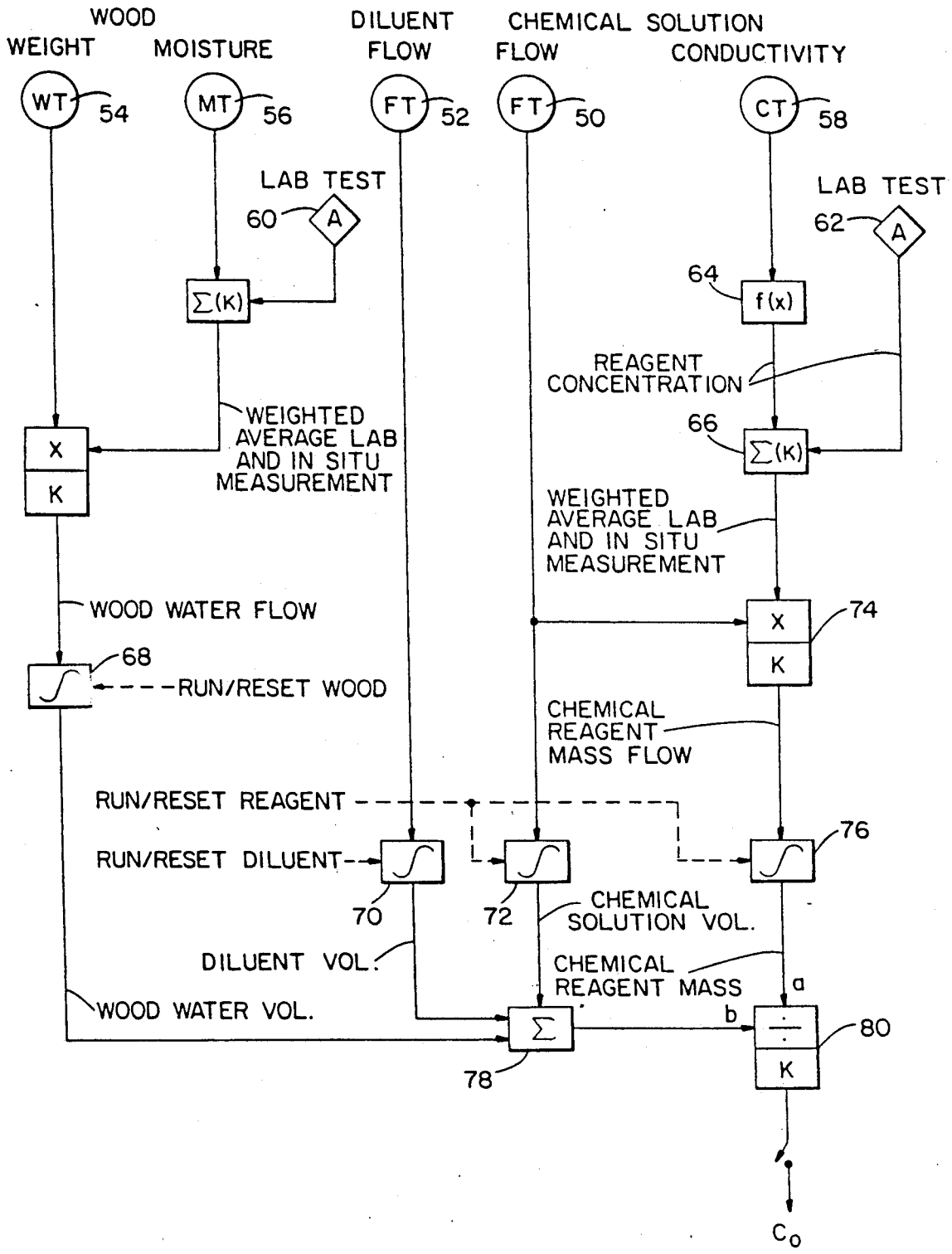
FIG. 3 is a schematic diagram of the logic required to produce a signal representative of the initial chemical concentration of the liquor within the digester.

The subsystem 14 produces an output measurement, $C_o$, representative of the cooking liquor initial chemical reagent concentration within the digester. Utilizing measured inputs, $C_o$ is inferred from a component balance with the logic which is shown in FIG. 3. As such, subsystem 14 requires transmitters for inlet chemical solution flow 50 and liquor diluent flow 52. Knowledge of the wood water contribution is necessary to complete the balance and therefore inputs for wood mass flow 54 and percent moisture by weight 56 are shown. Finally, subsystem 14 requires an input for the concentration of the reagent in the incoming chemical solution. A temperature compensated conductivity measurement 58, or other analytical sensor, is transmitted to facilitate inference of reagent concentration. Optionally, inputs for lab analytical results of wood moisture 60 and concentration of the chemical solution 62 are included to augment, replace, and/or calibrate the respective in situ measurements. The blocks process the measurements and integrate wood water, liquor diluent and chemical solution volumes when called for. In parallel, block 64 processes the chemical solution conductivity signal converting it to concentration units whereby it is further modified as a weighted average with the latest lab analysis 62 by block 66. Chemical concentration from block 66 is multiplied by the respective flow at block 74 and passed to integrator block 76 as inlet chemical reagent mass flow for totalization during the digesting charge cycle. Summer block 78 receives volumes for each of the inlet streams from their respective integrator blocks 68, 70 and 72 and outputs the total fluid volume charged for the digesting. Finally, block 80 divides the chemical mass from 76 by the fluid volume from 78, scales the result, and produces the initial chemical concentration, $C_o$, of the liquor medium within the digester in units of the spent liquor concentration measurement, $R_m$.

The foregoing measured variables H and $C_o$ of the delignification process are utilized as inputs to a process model 30 and a model parameter observer 48 which produces signals representative of reaction time constant, $\tau$, and a reaction conversion rate, B, which are, in turn, utilized as inputs to process model 30, process model 38, and model predictive control 36. The process model 30 produces an output signal, $K_a$, which is representative of the expected perturbation in actual Kappa Number for the process and an output signal, $R_a$, which is representative of the expected residual chemical concentration at blow-out of the digester. The foregoing outputs are applied to the minus inputs to addition function blocks 32 and 34, respectively. The model predictive control 36 produces an output $H_t$, which is the H factor target value, and an output $C_{ot}$, which is the initial chemical concentration target value, both of which are applied as inputs to the process model 38 which produces a Kappa Number target perturbation, $K_t$, and a residual chemical target value, $R_t$, as outputs therefrom. The foregoing target values are applied to the plus inputs to addition function blocks 32 and 34, respectively. The outputs of addition function blocks 32 and 34, which represent the model mismatch estimated errors for the Kappa Number and the residual chemical concentration, $e_K$ and $e_R$, respectively, are applied to the minus inputs to addition function blocks 40 and 42, respectively. The other inputs to addition function blocks 40 and 42 are the actual measured error $e_K$ for the Kappa Number and $e_R$ for the residual chemical concentration, respectively. These actual measured errors are the outputs of addition function blocks 44 and 46, respectively. The Kappa Number desired set point, $K_d$, is applied to the plus input to addition function block 44 and the measured Kappa Number, $K_m$, is applied to the minus input thereto. Similarly, the desired set point of the residual chemical concentration, $R_d$, is applied to the plus input to addition function block 46, and the actual residual chemical concentration, $R_m$, is applied to the minus input thereto. The outputs of addition function blocks 40 and 42 which represent the compensated control error $e_K'$ for the Kappa Number and the compensated control error $e_R'$ for the residual chemical concentration are applied as inputs to the model predictive control 36 which, in turn, modifies the initial chemical concentration of the liquor in the digester and the time versus temperature operating parameters of the digesters.

PULPING MODEL AND PARAMETER OBSERVATION

Derivation of Residual Chemical and Kappa Number Relationships

According to Carroll (see Pulp and Paper Manufacture, Volume I. *The Pulping of Wood*, sections 8.33–8.35, pps. 422–428, McGraw Hill, 1969) the rate of delignification for the Kraft process is proportional to the amount of lignin present in the wood, the alkali concentration present in the wood during the reaction, and the temperature dependent reaction rate. Presenting the relationship in modified form, $$\frac{dL}{dt} = -kCL \tag{1}$$

where,

L=Lignin content of chips (% of original dry wood)
C=Chemical reactant concentration of liquor in the chips (g/1, NaOH)
k=Temperature dependent reaction rate term
t=Reaction time The above is generally applicable and found throughout the literature. Note that k is expressed by the Arrhenius equation(see Pulp and Paper Manufacture, Volume I. *The Pulping of Wood*, sections 8.33–8.35, pps. 422–428, McGraw Hill, 1969) as follows:

$$k = k_o exp(F - E/RT) \tag{2}$$

where,

E=Activation energy (kJ/mol)
R=Universal gas constant (kJ/mol-K)
T=Absolute temperature (K)
$k_o$,F=Constants Since it is not readily known what the lignin content of the wood or the alkali concentration in the chips are, nor the presence and the nature of side reactions, a different formulation is required.

First, assume the lignin dissolution to be governed time-invariantly by free liquor chemical concentration. The pulping reactions shall cease as the free alkali is consumed approaching zero activity independent of time or temperature. Thus, for bulk delignification final value prediction, Kerr's work supports the following (see "Kinetics of Kraft Pulping—Batch Digester Control", *TAPPI Journal*, Vol. 59, No. 5, pps. 89–91, May, 1976).

$$\frac{dL}{dt} = a_1 \frac{dC}{dt} \tag{3}$$

where, $a_1$=Constant

Chemical concentration, C, however, cannot be readily monitored continuously during the course of the reaction. It is plausible to assume, similar to the relationship of the delignification rate (see Pulp and Paper Manufacture, Vol. 1, *The Pulping of Wood*, section 7.8, p. 284, McGraw Hill, 1969) that rate of chemical consumption is proportional to both the chemicals present and the rate of reaction.

$$\frac{dC}{dt} = -a_2 kC \tag{4}$$

where, $a_2$=Constant

Equation (4) is put into the form of a linear first-order differential equation, $$\frac{dC}{dt} + a_2 kC = 0 \tag{4a}$$

Integrating, the solution is $$C \exp(a_2 \int k dt) = D \tag{5}$$

where,

D=Constant

According to Vroom, H factor is the reaction rate, k, integrated over time (see Pulp and Paper Manufacture, Vol. 1, *The Pulping of Wood*, Sections 8.33–8.35, pps. 422–428, McGraw Hill, 1969).

$$H = \int k dt \tag{6}$$

Substituting into Equation (5), it becomes $$C \exp(a_2 H) = D \tag{7}$$

where, H, C are time dependent variables and $a_2$, D are constants. Manipulating, the solution is, $$C = D \exp(-a_2 H) \tag{8}$$

Considering the initial conditions at t=0, $$C(o) = C_o = D \exp[-a_2 H(o)] = D \tag{9}$$

since, from equation (6) H(0)=0. Rewriting the solution in Equation (8) for anytime t, $$C(t)=C_o \exp[-a_2 H(t)] \quad (10)$$

where, $C_o$=Initial chemical concentration, at t=0.

Equation (10) then describes the residual chemical concentration of the free liquor medium as a function of initial chemical application and time and temperature of the pulping process. Now considering the Equation (3) in differential form $$dL=a_1 dC \quad (11)$$

and integrating, $$\int_{L_o}^{L} dL = a_1 \int_{C_o}^{C} dC \quad (12)$$

the solution for L is, $$L-L_o=a_1(C-C_o) \quad (13)$$

Substituting for C from equation (10) and manipulating, $$L=L_o-a_1C_o[1-\exp(-a_2H)] \quad (14)$$

Equation (14) can be written in terms of industry standards, such as Y (yield) or K (Kappa number). Choosing K, $$K=A+BC_o[1-\exp(-H/_{96})] \quad (15)$$

where,

K=L=Pulp residual lignin, indicated by degree of delignification lab test (K/Kappa No., etc.)

$A \doteq L_o$=Intercept corresponding to theoretical Kappa number of raw wood $B=-a_1$=Slope, or conversion rate $C_o$=Chemical concentration as gram/liter or in terms of bone dry wood mass on a percentage basis H=Vroom's H factor or time-temperature reaction rate model $\tau=(1/a_2)$=First-order reaction constant characteristic Observation of Model Parameters Consider the Equation (10) and parameter definition $\tau=(1/a_2)$ in Equation (15), $$C=C_o \exp(-H/\tau) \quad (16)$$

Now, for a particular residual (subscript r) during the reaction process, $$C_r=C_o \exp(-H_r/\tau) \quad (17)$$

holds. Consider, also, the termination of reaction (99.5% complete) at approximately $H_f=5_\tau$.

$$C_f=C_o \exp(-5)=6.738E\text{-}03\ C_o \quad (18)$$

Dividing Equations (17) and (18), $$\frac{C_f}{C_r}=\frac{C_o\exp(-H_f/t)}{C_o\exp(-H_r/t)}=\frac{\exp(-H_f/t)}{\exp(-H_r/t)} \quad (19)$$

Substituting for $C_f$ from Equation (18), $$\frac{6.738E\text{-}03\ C_o}{C_r}=\frac{\exp^{-5}}{\exp(-H_r/t)}=\frac{6.738E\text{-}03}{\exp(-H_r/t)}$$

which yields $$\exp(-H_r/t)=\frac{C_r}{C_o} \quad (20)$$

Taking the natural logarithm and manipulating, $$\tau=\frac{H_r}{\ln(C_o/C_r)} \quad (21)$$

It is possible to make several measurements of $H_r$, $C_r$ for a given initial concentration $C_o$ and find several $\tau$ values for the process and compare them for accuracy of the method. The values are averaged for a suitable $\tau \cdot \tau$ a time constant indicating the speed of reaction. Furthermore, the values of the parameters A and B are to be determined as follows:

Consider two different cooking conditions such as 1 and 2 corresponding to initial concentrations $C_{01}$ and $C_{02}$. Also, assume that these two reactions are for the same wood species. The common time constant $\tau$ is found as in Equation (21). Equation (15) is repeated for two conditions, $$K_1=A+BC_{01}[1-exp(-H_1/t)] \quad (22)$$

$$K_2=A+BC_{02}[1-exp(-H_2/t)]$$

Note that for the same wood the initial Kappa numbers in conditions 1 and 2 are the same and equal to A. Furthermore, $K_1$ and $K_2$ correspond to the desired Kappa numbers at the end of cooking for the conditions 1 and 2. Here, it is implied that B is a constant for a given wood species.

Subtracting $K_1$ and $K_2$ in Equation (22), $$K_1-K_2=B[C_{01}(1-exp(-H_1/\tau))-C_{02}(1-exp(-H_2/\tau))]$$

manipulating $$B=\frac{k_1-k_2}{Co_1[1-\exp(-H_1/\tau_1)]-Co_2[1-\exp(-H_2/\tau_2)]} \quad (23)$$

is obtained. Note that the above relationship can alternately be written by the partial derivatives for one condition which many mills may desire to use. Consider, from Equation (15), the partial derivative of K with respect to initial concentration $C_o$, $$\left.\frac{\partial K}{\partial C_o}\right|_{H=constant}=B[1-\exp(-H/t)] \quad (24)$$

where the cooking process is considered to have the same temperature/time profile per Equations (2) and (6). Therefore, H is a constant since H is a function of time and temperature. Then, B is written as $$B = \frac{\partial K/\partial C_o}{1 - \exp(-H/t)} \tag{25}$$

Using the difference relations for the derivative, we have $$B = \left(\frac{\Delta K}{\Delta C_o}\right)\frac{1}{1 - \exp(-H/t)} \tag{26}$$

Note that B is directly related to the sensitivity of K with respect to $C_o$ as defined by the mill.

It is also possible to find the constant B for the same initial chemical concentration $C_o$ but under varying cooking conditions (temperature profile) which means varying H. Accordingly, $$\left.\frac{\partial K}{\partial H}\right|_{C_o = constant} = \frac{BC_o\exp(-H/t)}{t} \tag{27}$$

which leads to (by difference relationship)

$$B = \left(\frac{\Delta K}{\Delta H}\right)\frac{t}{C_o\exp(-H/t)} \tag{28}$$

Note that, here, B is directly related to the sensitivity of K with respect to H.

Now for any of the conditions discussed in the preceding, A can be found by substituting the B values found into Equation (15). It is noted that A is not required by the controller implementation.

Figure 4:
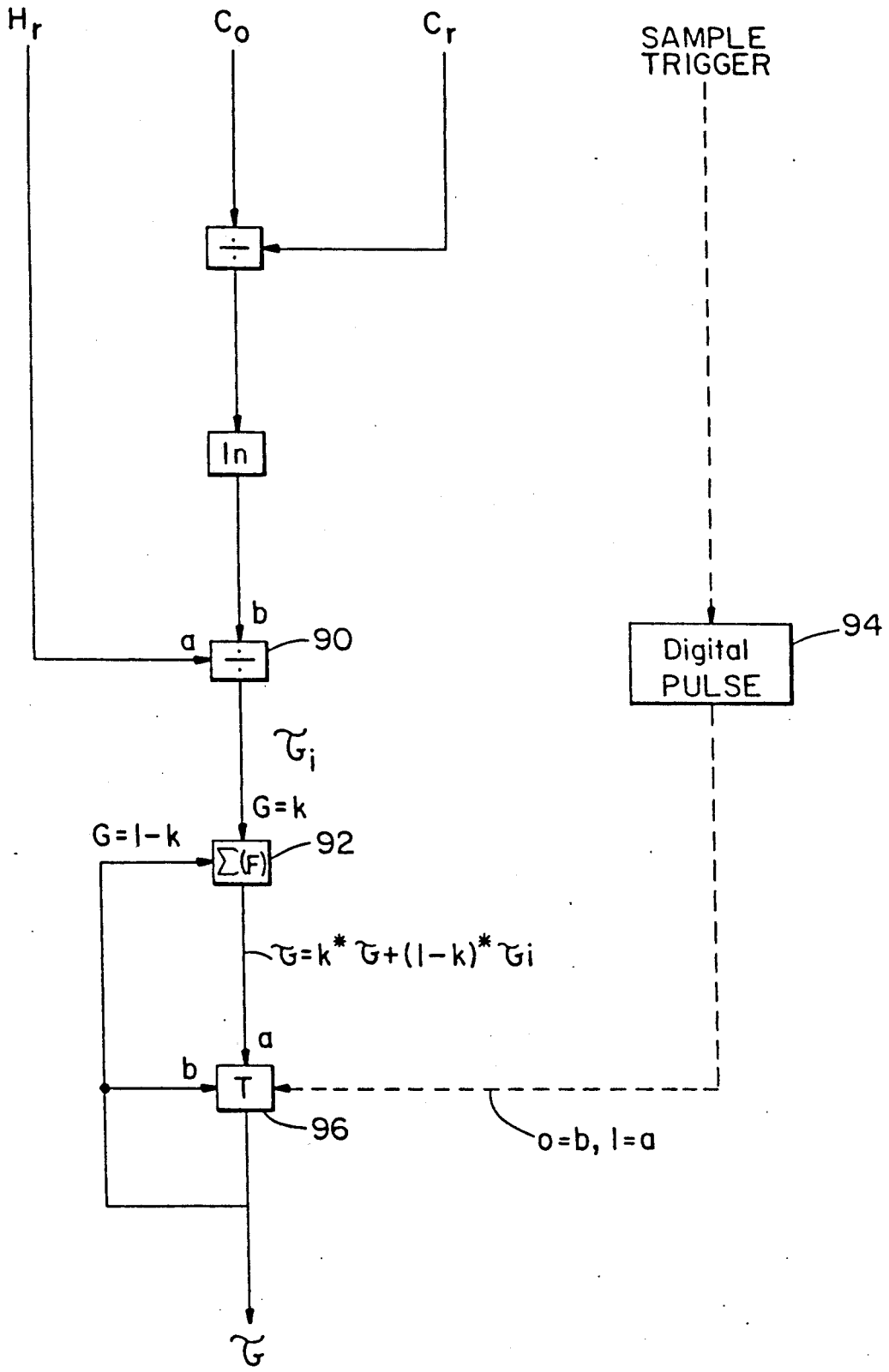
FIG. 4 is the schematic diagram of the logic required to produce a signal representative of the reaction time constant of the model for the pulping reactions.

The details of model parameter observer 48 which produces the reaction time constant, $\tau$, and the reaction conversion rate, B, are given in FIGS. 4 and 5, respectively. The observing and updating of the reaction time constant, digesting to digesting, is by equation 21 given a sampled measurement of cooking liquor residual chemical concentration, $C_r$, at a known moment with corresponding H factor, $H_r$, provided by subsystem 10, and a corresponding initial concentration for the digesting, $C_o$, provided by subsystem 12. Note the $C_r$ may represent the concentration of the discharged liquor, $R_m$, whereby H factor, $H_r$, would be that representing the termination of the corresponding digesting. FIG. 4 shows the logic to implement the aforementioned with block 90 producing the new observation of the $\tau$ at the moment of the sample trigger. New observations are weighted with previous observations by the discrete first-order filter constructed by blocks 92, 94 and 96. Block 92 produces a weighted sum of the new value with that of the previous filter output corresponding to input b of the transfer block 96 where k is a fraction greater than zero and less than one and the quantity (1−k) represents the discounting factor of the previous observations. Block 94 outputs a sampling instance signal to update the filter transfering input a, the new weighted sum produced by block 92, through the transfer block 96 producing a new filtered $\tau$ and passing the same as the previous filter output for the next sampling to input b of the same block as a means of sample and hold.

Figure 5A:
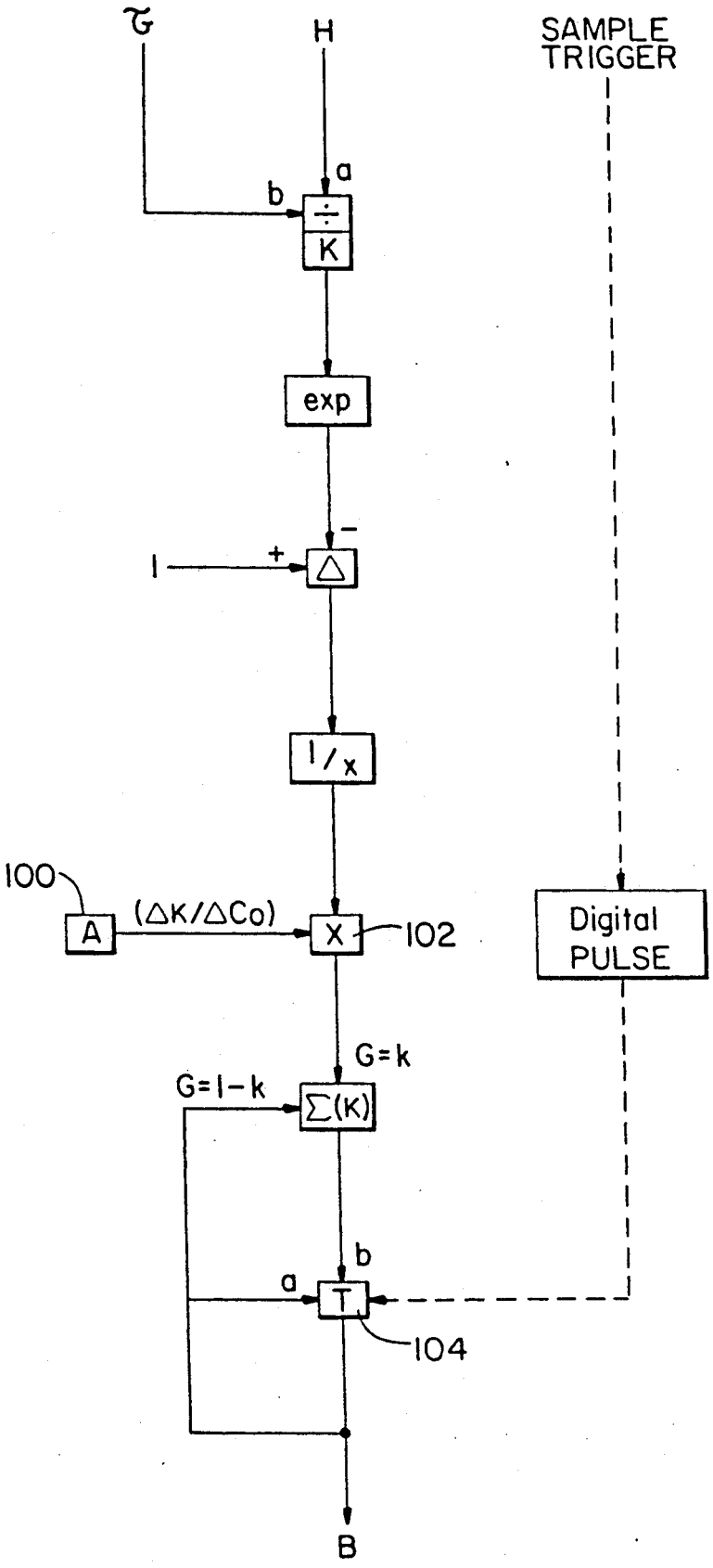
FIGS. 5*a* and 5*b* are the schematic diagram of the logic required to produce a signal representative of the reaction conversion rate of the model for delignification..
Figure 5B:
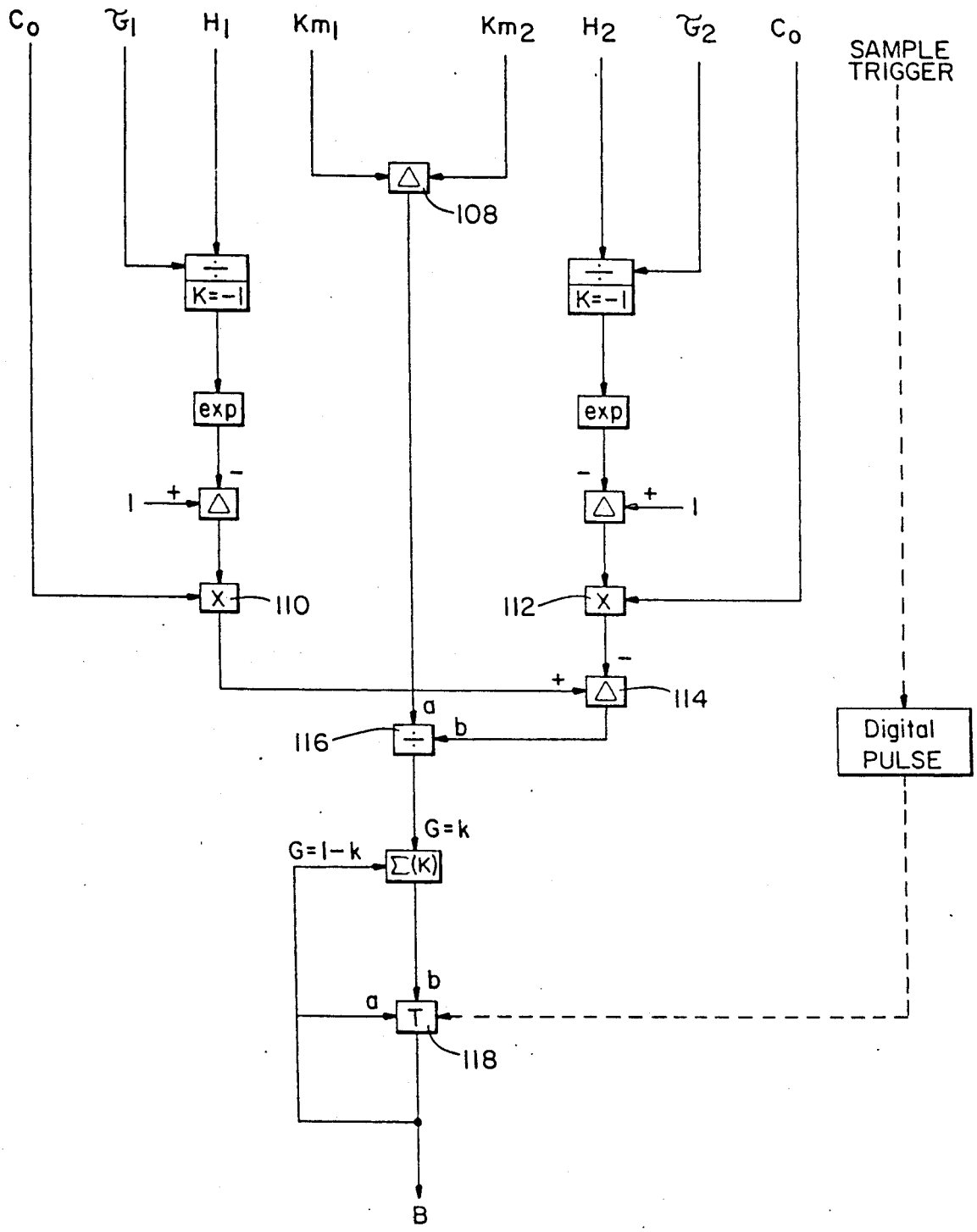

The observing and updating of reaction conversion rate B is by equation 26 as shown in FIG. 5*a*, and alternatively, by equation 23 as shown in FIG. 5*b*. As illustrated in FIG. 5*a*, several operational blocks process values of H, produced by subsystem 10, and, $\tau$ produced by block 96 of FIG. 3, with known sensitivity constant ($\Delta K/\Delta C_o$) for the operating range, input at block 100, to implement equation 26 and produce a new observation of B from block 102 at the sampling instant. Block 104 outputs the filtered observation B. For two operating conditions, 1 and 2, representing time-shifted conditions of the same process or current conditions for two processes operating in parallel, both pulping the same wood chip stock to different endpoints, B may be observed by implementing equation 23 as shown in FIG. 5*b*. Operational blocks process H, $\tau$ and $C_o$ for each set of conditions and produce outputs from multiplier blocks 110 and 112, respectively per equation 23, and subsequently difference them at block 114 to produce the denominator of the same equation. Further, Kappa measurements, $K_m$, for each condition is mapped to its corresponding set of input conditions and processed in parallel with the aforementioned. The respective $K_m$ are differenced at block 108 to produce the numerator of equation 23 and input to block 116 to be divided by the output value of block 114 the result of which is a new observation B for the sampling instance. Block 118 outputs the filtered observation B.

MULTIVARIABLE PROCESS MODEL AND SUPERVISORY CONTROL

A simple process model comprising of only two parameters, both physically meaningful, is used for control implementation. Process characteristics may be monitored and updated in real time without extensive calculations (e.g., recursive least squares estimation).

Process Model

A nonlinear process model has two inputs and two outputs. Consider Equations (15) and (17) respectively $$K = A + B[C_o(1 - exp(-H/\tau_6))] = f_k(C_o, H) \tag{29}$$

$$R = C = C_o exp(-H/\tau_6) = f_R(C_o, H) \tag{30}$$

where C is labeled as R. The partial derivatives from Eqns. (29), (30) are $$\left|\frac{\partial K}{\partial C_o}\right|_H = B[1 - \exp(-H/t)] \tag{31}$$

$$\left|\frac{\partial K}{\partial H}\right|_{C_o} = \frac{BC_o\exp(-H/t)}{t} \tag{32}$$

Similarly for $R$:

$$\left|\frac{\partial R}{\partial C_o}\right|_H = \exp(-H/t) \tag{33}$$

$$\left|\frac{\partial R}{\partial H}\right|_{C_o} = -\frac{C_o}{t}\exp(-H/t) \tag{34}$$

considering linearization.

$$K = K_{ss} + \Delta K \simeq K_{ss} + \left|\frac{\partial K}{\partial C_o}\right|_H \Delta C_o + \left|\frac{\partial K}{\partial H}\right|_{C_o} \Delta H \tag{35}$$

$$R = R_{ss} + \Delta R \simeq R_{ss} + \left|\frac{\partial R}{\partial C_o}\right|_H \Delta C_o + \left|\frac{\partial R}{\partial H}\right|_{C_o} \Delta H \tag{36}$$

-continued which, for variations in linearized form, yields $$\Delta K = \left|\frac{\partial K}{\partial C_o}\right|_H \Delta C_o + \left|\frac{\partial K}{\partial H}\right|_{C_o} \Delta H = g_{11}\Delta C_o + g_{12}\Delta H \quad (37)$$

$$\Delta R = \left|\frac{\partial R}{\partial C_o}\right|_H \Delta C_o + \left|\frac{\partial R}{\partial H}\right|_{C_o} \Delta H = g_{21}\Delta C_o + g_{22}\Delta H \quad (38)$$

These equations are written in matrix form as $$\begin{bmatrix} \Delta K \\ \Delta R \end{bmatrix} = \begin{bmatrix} g_{11} & g_{12} \\ g_{21} & g_{22} \end{bmatrix} \begin{bmatrix} \Delta C_o \\ \Delta H \end{bmatrix} \quad (39)$$

Concept of Multivariable Supervisory Control

One must first accomplish stabilization of the whole pulp cooking cycle as a means of an underlying basis for supervision control.

Secondly, this model based supervisory control is developed in terms of equations in deviation form and performs well despite significant model discrepancies. Rather than inferring a process disturbance and driving the control accordingly, the relative effect of control mismatch on the controlled variable is estimated. This is done by measuring the difference between the target inputs generated by the supervisory controller and the actual process inputs.

Relationships for the model-based supervisory control are developed as follows. Consider the supervisory controller gain matrix which develops predicted values for the process input variations $\Delta C_o$ and $\Delta H$ from the process variations (errors) $\Delta K$, $\Delta R$. Such a relationship is described in matrix form, $$\begin{bmatrix} \Delta C_o \\ \Delta H \end{bmatrix} = \begin{bmatrix} K_{11} & k_{12} \\ k_{21} & k_{22} \end{bmatrix} \begin{bmatrix} \Delta K \\ \Delta R \end{bmatrix} \quad (40)$$

where $$k_{11} = \frac{\partial C_o}{\partial K}\Big|_{H=constant} \quad (41)$$

$$k_{12} = \frac{\partial C_o}{\partial R}\Big|_{H=constant}$$

$$k_{21} = \frac{\partial H}{\partial K}\Big|_{C_o=constant}$$

$$k_{22} = \frac{\partial H}{\partial R}\Big|_{C_o=constant}$$

Inverting the Equations (31) through (34) provides the values of the elements, k, of the gain matrix as follows $$k_{11} = \frac{1}{B[1 - \exp(-H/t)]} \quad (42)$$

$$k_{12} = \frac{1}{\exp(-H/t)} \quad (43)$$

$$k_{21} = \frac{t}{BC_o \exp(-H/t)} \quad (44)$$

-continued $$k_{22} = -\frac{t}{C_o \exp(-H/t)} \quad (45)$$

Note that the respective elements g and k of the process gain matrix and the controller gain matrix are related as $$k_{11} = \frac{1}{g_{11}},\ k_{12} = \frac{1}{g_{21}},\ k_{21} = \frac{1}{g_{12}},\ k_{22} = \frac{1}{g_{22}} \quad (46)$$

where the matrix k is the inverse of the process gain matrix g.

The goal of the control strategy is to control pulp Kappa number and spent liquor residual chemical through automatic adjustment of the initial chemical charge and H factor targets. Other control elements then work to apply chemical solutions and cook the pulp within time/temperature tolerances to a final H factor to meet the respective supervised targets.

Success of bringing pulp quality under control has been attributed to the implementation of a cooking model based control strategy. A substantial decrease in pulp variation is accomplished by bringing all phases of the pulp cooking cycle under close continual scrutiny which stabilizes the process.

Industrial pulping facilities do not provide for perfectly stirred reaction environments. Rather, significant pulp variation exists within a given digester despite measures such as forced liquor recirculation, etc. Any effort to control better than the underlying process variation will induce additional controlled variable deviation. This issue must be addressed by the supervisory controller.

In addition, the supervisory control strategy must deal with other undesirable process characteristics. Long and variable time delays exist between the charging, cooking, discharging and pulp processing operations and the eventual pulp sampling point. Additional information delay is then brought on by the testing and reporting procedures. As a result, some uncertainty exists as to the source and time of the pulp digestion complicating the feedback mechanism further. Open loop "manual" operation also presents a problem for the supervisory controller. At times, lack of proper pulp mill coordination and external disturbances such as steam availability or downstream unit outages disrupt the cooking process. As a consequence, cooking deviates from the desired time/temperature profile often exceeding the specified H factor. The effects of these anomalies must be considered by the supervisory controller to prevent additional process output excursions.

Multivariable Supervisory Control Implementation

The block diagram of the control philosophy is shown in FIG. 1. In this concept, it is assumed that two values of the process end product are to be controlled, pulp Kappa number and liquor residual chemical concentration, by the inputs of Co and H which are defined previously. A pulp mill determines the desired values of Kappa number $K_d$ and residual chemical $R_d$ by consideration of mill economics, operating constraints, process capability, and the end product specifications.

FIG. 1 shows a detailed block diagram of the supervisory controls. Referring to FIG. 1 the Process Model block receives, for each cook result, the target values for initial chemical concentration and H factor, $C_{ot}$ and $H_t$, and uses the process model Equations (29) and (30) to find the equivalent target values for perturbations in K and R as follows, $$K_t = B[C_{ot}(1-exp(-H_t/\tau))] \quad (47)$$

$$R_t = C_{ot}exp(-H_t/\tau) \quad (48)$$

Note that in Equation (47) the A term in Equation (29) is dropped as perturbation variables are to be used. Similarly, the other Process Model block uses the actual measured values of $C_o$ and H for each cook to generate expected perturbations $K_a$ and $R_a$ as follows, $$K_a = B[C_o(1-exp(-H/t))] \quad (49)$$

$$R_a = C_o exp(-H/t) \quad (50)$$

To compensate for open loop operation, an estimate of controlled variable deviation e, due to control mismatch, is calculated by comparing the output of each Process Model block (FIG. 1). Upon entry of the controlled variable lab test result, a corrected control error e' is generated, by modifying the measured error, e, by the estimated error, e. These procedures are summarized for K as $$\Delta K = (K_d - K_m) - (K_l - K_n) = e_K - e_K = e_K' \quad (51)$$

The above also holds for the controlled variable R. Process throughput modelling and sample/time correlation facilitate this open loop compensation. As uncertainty often still prevails, rules are applied to the corrected control error to promote conservative and reliable control action.

The controlled variable deviations are monitored to construct control charts in real time. Statistical process control trend pattern analysis then governs the control update. In this way, supervisory corrections are only initiated when the underlying system exhibits variations indicating the presence of nonstationary disturbances not compensated for.

Details of the control are shown in FIG. 1. Here the Model Predictive Gain Matrix, per Equation (40), is employed to find adjustments for $C_o$ and H given deviations in ΔK and ΔR as represented by their respective control errors, $e_K'$ and $e_R'$. Each of the errors may be discretely filtered for a desired feedback trajectory designed for uncertainty. These incremental adjustments are then applied to existing setpoint biases. Integration is provided by sample/hold unity feedback addition of the respective biases. The outputs of the Model Predictive Controller are sent to the underlying system as remote supervisory setpoints and become the biases for the next control iteration.

Control to the chemical addition target is carried out for subsequent charging operations. Deviations in the chemical charge are compensated for by a feedforward adjustment to H factor on an individual cooking basis by the supervisory controller. If a residual chemical concentration measurement is available during a digesting, an additional feedforward H factor target adjustment signal may be developed based on an offset of the residual from an expected value to control Kappa or final residual chemical concentration, or a weighted function of both. Time and temperature controls then work to achieve H factor at a precise endpoint moment to initiate pulp discharge. Other coordinating control elements schedule pulping activities to solve the logistic problems associated with shared systems and surge tank capacity management.

The control functions are implemented by simple function blocks. These function block algorithms are configured from control diagrams drawn by SAMA Standard. Control system hardware is common throughout; however, distributed and partitioned functionally for maximum security and maintainability.

Figure 6:
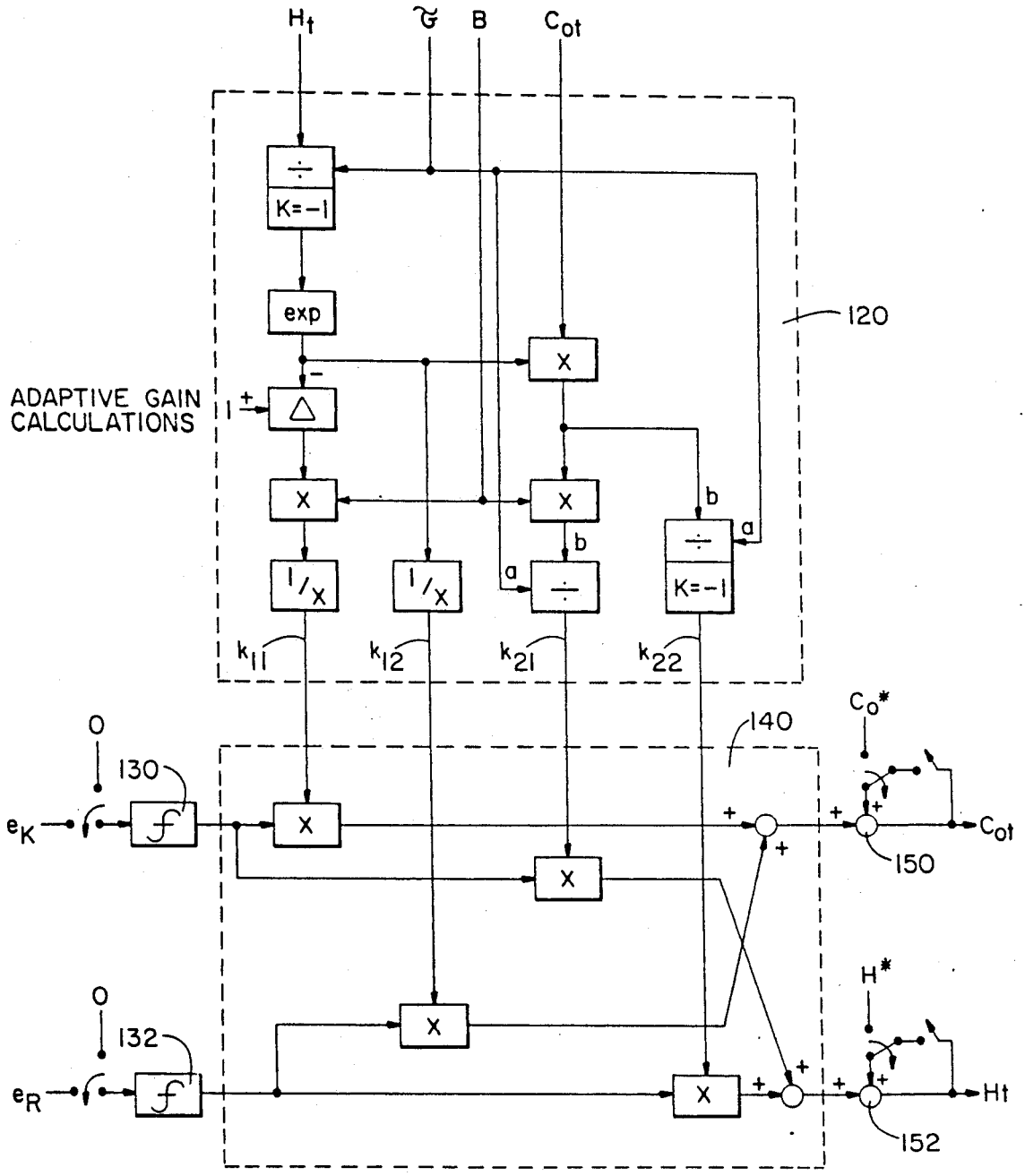
FIG. 6 is the schematic diagram of the control logic required to produce signals for the target values of initial charge chemical concentration and the H factor for the delignification process respectively.
Figure 7:
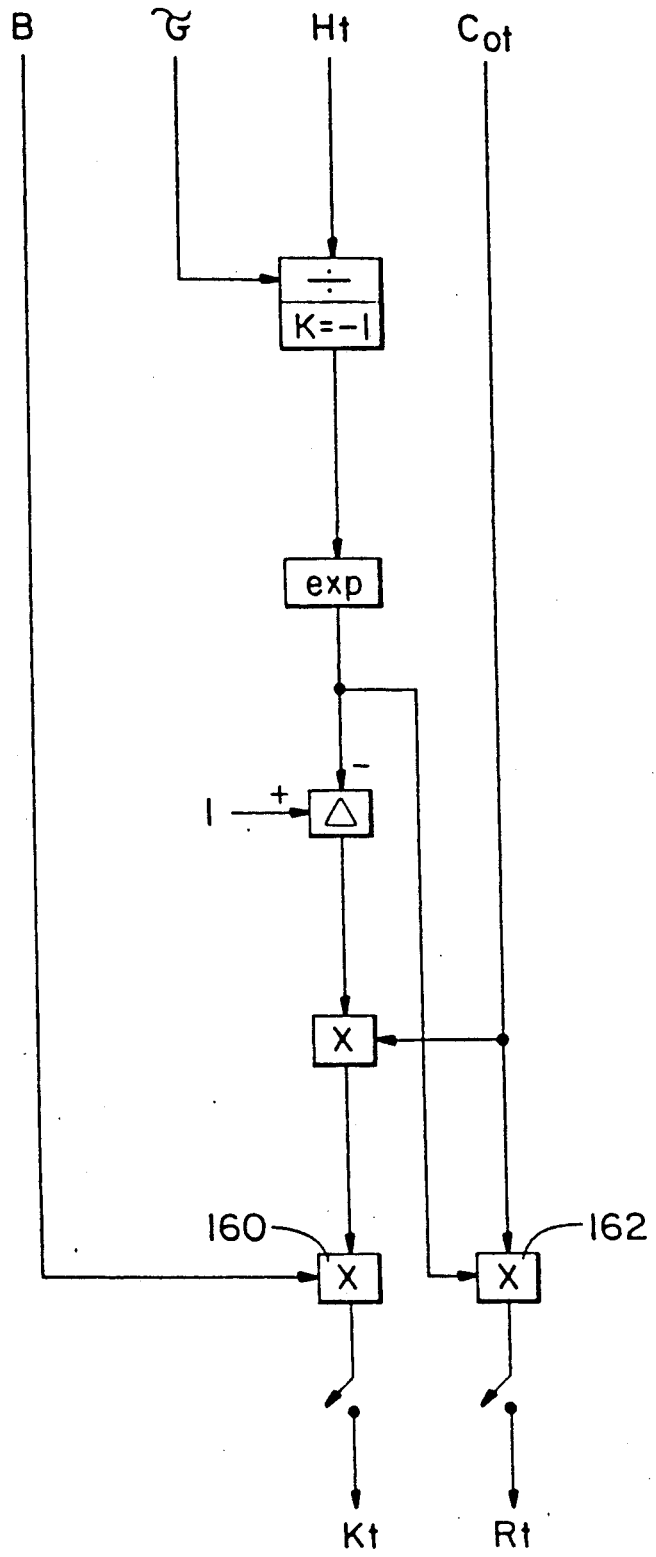
FIG. 7 is the schematic diagram of the logic to produce signals representative of the expected or target values for the perturbations in the Kappa Number and chemical residual concentration.

The operation of model predictive control 36 in FIG. 1 is illustrated in FIG. 6. FIG. 6 is comprised of adaptive gain calculations 120, diagonal closed-loop response trajectory filter 130 and 132, model predictive gain block 140, and others, as illustrated. The block 120 receives the current targets, $H_t$ and $C_{ot}$, internally produced by blocks 152 and 150, respectively, and model parameters $\tau$ and B produced by block 96 of FIG. 4 and by blocks 104 or 118 of FIG. 5, respectively. Block 120 then produces steady state gains, k11, k12, k21 and k22, per equations 42–45, to be utilized by gain block 140. Further, compensated control errors $e'_K$ and $e'_R$ produced by block 40 and 42 of FIG. 1, respectively, are each discretely filtered for desired feedback/servo response shaping and robustness by blocks 130 and 132, respectively, and passed to block 140 for control execution. Block 140 then performs the matrix multiplication per equation 40 as illustrated to output control effort perturbations in $C_{ot}$ and $H_t$. The perturbations are added to their respective previous values at blocks 150 and 152 for the sampling instance, output to the underlying process, and then held until the next control sampling instance whereby they become the previous values. Integral action is then supplied by this unity feedback addition. Also shown are switch positions illustrating manual to automatic control bumbless transfer. When the controller is not activated by the operator (manual), it is made to track and output the current local target settings of the process, $C_o$* and H*, while the control errors and internal states of the filters are forced to zero. FIG. 6 illustrates the controller in the automatic mode of operation. The details of process model blocks 30 and/or 38 in FIG. 1 are illustrated by FIG. 7 which receives signals $C_{ot}$ and $H_t$ produced by block 36 in FIG. 1 and the signals B and $\tau$ produced by block 48 in FIG. 1. The functional operation to produce the target values $K_t$ and $R_t$ of the Kappa Number and residual chemical concentration from blocks 160 and 162, respectively, are illustrated by the functional blocks of FIG. 7 processing the inputs according to equations 47 and 48. The operational details of block 30 are identical to that of FIG. 7 except that the signals received by block 30 are H and $C_o$ instead of $H_t$ and $C_{ot}$ to implement equations 49 and 50.

Control System Architecture

Function block programming is now customarily used throughout the control industry. These function blocks are implemented by a distributed microprocessor system having many advanced features. In this microprocessor system, each processing element is dedicated to performing some specific functions just as in the case of analog and sequential control systems. These elements are then linked to form a completely integrated process control system having a highly parallel distributed architecture. The best features of both analog and digital systems are combined in this way. In addition, the system can interface with an unlimited variety of external intelligent devices (open system architecture) including mainframe computers.

Figure 8:
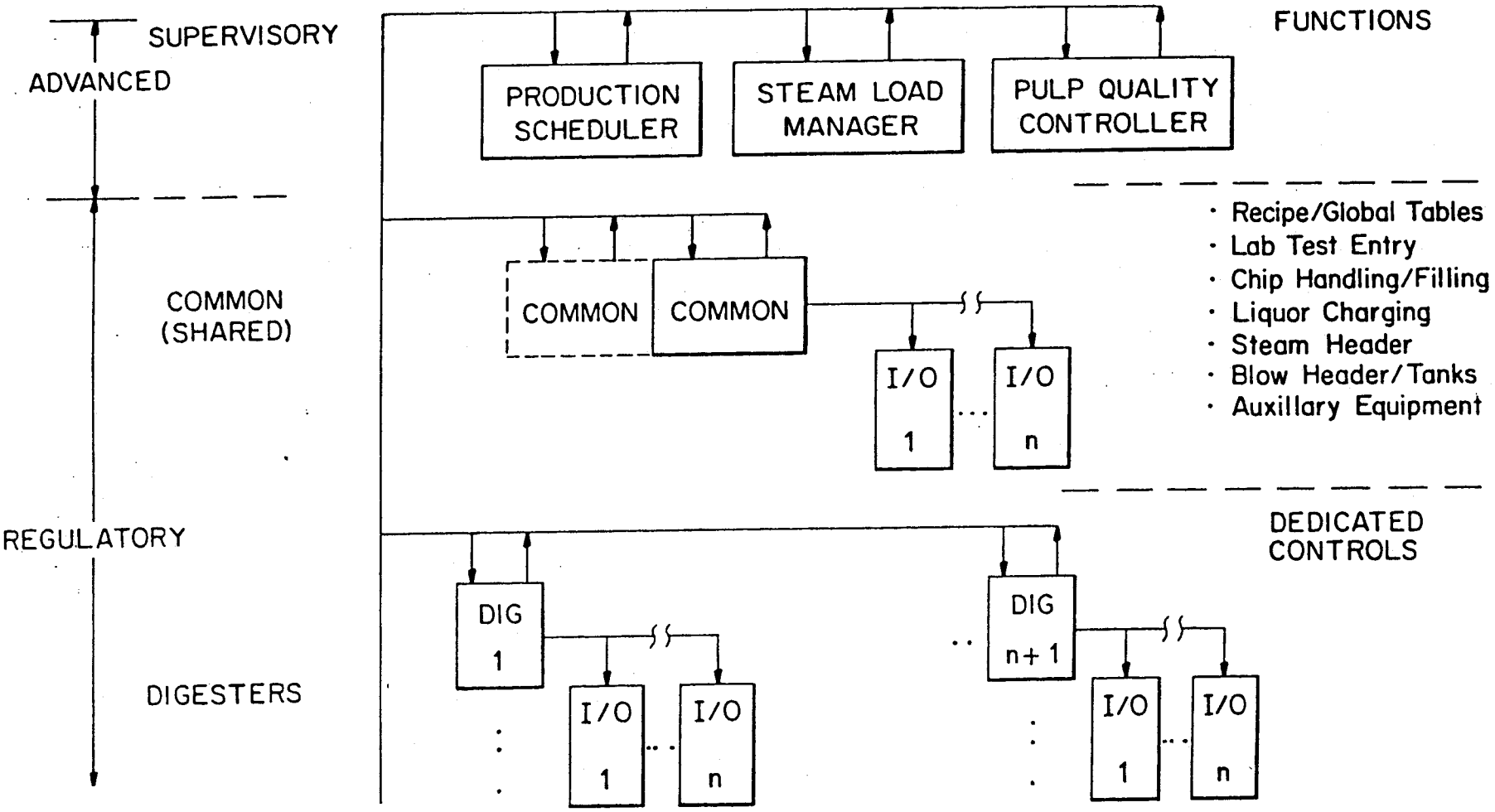
FIG. 8 is a batch digester control hardware architecture schematic.

The control hardware architecture for a pulp mill batch digester house application is shown in FIG. 8. Each labeled box represents a powerful stand alone computing controller. This same controller is employed throughout the system performing dedicated functions as indicated. Data is exchanged freely between the controllers over the digital communication network to facilitate coordination of the common systems and supervision of the individual digesters.

Each dedicated digester controller performs all safety interlocking, device sequencing, regulatory controls for temperature, inlet steam flow and pressure relief and calculations, such as H factor, specific for the individual digester. The common controller handles first in, first out servicing and control of the filling, charging and blowing sequences, as well as processing of lab data entry information. Finally, the supervisory level controls are integrated into the system and separated out functionally as shown. Remote commands and setpoints designed to further automate and optimize the process are communicated to each digester and common controller.

The supervisory modelling and control of the pulp Kappa number and spent liquor residual chemical is performed by the "Pulp Quality Controller" block of FIG. 8. Real time scheduling and automation of batch digester filling, cooking and blowing is performed by the "Production Scheduler". Desired production rates are maintained and cooking rates are controlled as a means to manage blow tank level and avoid "held" cooks. In addition, individual digester steaming rates are supervised by the "Steam Load Manager" to match production and minimize steam header swings. Collectively, the supervisory controls work to automate, coordinate and optimize the batch digester house pulping process.

Several features of the distributed microprocessor system are:

1. Failure of a single processing element does not cause system shutdown (fault tolerance).
2. Total redundancy, error detection and correction, and fault diagnostic capabilities are standard features.
3. No programming is required for function blocks and the control functions are configured easily. However, "BASIC" and "C" programs may be implemented in the same hardware along with the other standard function blocks.
4. The accuracy and flexibility features of full floating point digital implementation of a powerful set of function block algorithms are provided.
5. Computing elements run in parallel with none of the capacity or response drawbacks of a serial centralized computer implementation.
6. Wiring and installation costs are greatly reduced. Each computing element may communicate digitally with any other element.
7. CRT consoles are used instead of conventional panelboard instruments resulting in savings in control room size and cost and, more importantly, this provides a consistent ergonometrically designed operator interface to minimize fatigue and catastrophic plant failures due to operator error.

From the foregoing, it is apparent that two process variables, the Kappa Number and the residual chemical concentration are controlled simultaneously by the multivariable supervisory control techniques to provide an efficient operation. The calculations are performed in real-time to predict the process variables, and the parameter values of the model used in calculations are updated continuously by direct observation. The control system of the present invention minimizes variations in the Kappa Number and maintains a uniform residual chemical concentration which provides a number of advantages over the prior art. For example, this control system assures adequate delignification plus proper endpoint environment, preventing lignin condensation and loss of yield. In addition, it minimizes cellulose degradation and resulting decrease in pulp yield and strength properties. Furthermore, it maintains inorganic loading on chemical recovery operations to a level such as to remove downstream mill production bottlenecks. In addition, it enhances the washability of the pulp produced and prevents excessive chemical scaling of the spent liquor evaporator tubes.

With respect to the method of implementing the system, the model parameters have physical meaning and are readily measurable. In addition, only two model parameters are required which provide simple formulation as opposed to working with a plurality of variables and control actions sensitive to modeling error.

Further, the following design features of the supervisory controller collectively enhance its accuracy and robustness given the undersirable characteristics of the process;

- controller linearization with all calculations performed in terms of perturbation variable;
- model parameters that are well understood and physically meaningful and readily observable directly from process data thus adjusting the controller gains to time varying characteristics of the process;
- control change dictated by SPC analysis and detection of nonstationary disturbances so as to prevent unwarranted response to frequencies unrejectable by feedback regulation;
- the ability to add feedforward control for each digesting given a cooking liquor chemical concentration measurement during the course of digesting.

Lastly, no calculation delays due to the compilation time of high level computer programming and no accuracy and flexibility problems inherent in analog computers exist with the present system. Furthermore, no specialized personnel are needed to implement the system.

Certain modifications and improvements will occur to those skilled in the art upon reading the foregoing. It should be understood that all such modifications and improvements have been deleted herein for the sake of conciseness and readability, but are properly within the scope of the following claims.

We claim:

1. In a delignification control system using a supervisory control gain matrix for developing predicted values for process input variations of initial chemical concentration $\Delta C_o$ and Vroom $\Delta H$ factors from process variations of K number, $\Delta K$ and residual chemical concentration $\Delta R$, the system comprising:

means for measuring a difference between target inputs and actual process inputs and establishing signals indicative thereof;

means for producing predicted values according to a matrix format as follows:

$$\begin{bmatrix} \Delta C_o \\ \Delta H \end{bmatrix} = \begin{bmatrix} K_{11} & K_{12} \\ K_{21} & K_{22} \end{bmatrix} \begin{bmatrix} \Delta K \\ \Delta R \end{bmatrix}$$

where the k's are the elements of a predictive controller gain matrix and establishing signals indicative thereof, where:

$$k_{11} = \frac{1}{B[1 - \exp(-H/t)]}$$

$$k_{12} = \frac{1}{\exp(-H/t)}$$

$$k_{21} = \frac{t}{BC_o \exp(-H/t)}$$

$$k_{22} = \frac{t}{C_o \exp(-H/t)}$$ ; and means for controlling pulp Kappa number and spent liquor residual chemical by adjusting initial chemical charge and H-factor targets responsive to said signals.

2. In a delignification control system as set forth in claim 1, said system further comprising means for developing process gain values signals in a simplified matrix format as follows:

$$\begin{bmatrix} \Delta K \\ \Delta R \end{bmatrix} = \begin{bmatrix} g_{11} & g_{12} \\ g_{21} & g_{22} \end{bmatrix} \begin{bmatrix} \Delta C_o \\ \Delta H \end{bmatrix}$$

where the g's are the elements of a process gain matrix derived from the following semitheoretical pulping model developed herein as follows:

$$K = A + BC_o(1 - exp(-H/_{96})) \quad (15)$$

$$R = Co\ exp\ (-H/_{\tau}) \quad (10)$$

* * * * *